US009815168B2

(12) United States Patent
Richardson, Jr. et al.

(10) Patent No.: US 9,815,168 B2
(45) Date of Patent: Nov. 14, 2017

(54) APPARATUS AND METHOD FOR HONING TUBULARS OF A WELLSITE

(71) Applicant: National Oilwell Varco, L.P., Houston, TX (US)

(72) Inventors: Lendon W. Richardson, Jr., Tomball, TX (US); Trenton P. Carroll, Sealy, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 224 days.

(21) Appl. No.: 14/641,162

(22) Filed: Mar. 6, 2015

(65) Prior Publication Data

US 2015/0251292 A1 Sep. 10, 2015

Related U.S. Application Data

(60) Provisional application No. 61/949,862, filed on Mar. 7, 2014.

(51) Int. Cl.

| | |
|---|---|
| ***B24B 33/04*** | (2006.01) |
| ***B24B 33/08*** | (2006.01) |
| ***B24B 5/04*** | (2006.01) |
| ***B24B 33/05*** | (2006.01) |
| ***E21B 17/00*** | (2006.01) |

(52) U.S. Cl.

CPC ..... *B24B 33/04* (2013.01); *B24B 5/04* (2013.01); *B24B 33/05* (2013.01); *B24B 33/08* (2013.01); *B24B 33/081* (2013.01); *B24B 33/083* (2013.01); *E21B 17/00* (2013.01)

(58) Field of Classification Search

CPC B24B 5/04; B24B 33/04; B24B 33/08; B24B 33/081; B24B 33/083

USPC .... 451/49, 51, 181, 425, 441, 464, 484, 487

See application file for complete search history.

(56) References Cited

U.S. PATENT DOCUMENTS 1,742,256 A * 1/1930 Jessop ..... F16C 33/18 137/433
1,928,506 A * 9/1933 Sellberg ..... B24B 33/081 451/181
2,162,187 A * 6/1939 Tharp ..... B24B 33/04 451/181

(Continued)

FOREIGN PATENT DOCUMENTS

| | | |
|---|---|---|
| DE | 8814248 | 2/1989 |
| GB | 369164 | 3/1932 |
| JP | 60100147 | 6/1985 |

OTHER PUBLICATIONS

Honematic "ID & OD Honing" Brochure, retrieved on or before Jan. 15, 2014, [retrieved from internet URL: http://www.honematic.com/id-od-honing.php], 1 page.

(Continued)

*Primary Examiner* — Eileen Morgan

(74) *Attorney, Agent, or Firm* — Conley Rose, P.C.

(57) ABSTRACT

The disclosure relates to a tool for honing a tubular component of a wellsite. The honing tool includes a base operatively connectable to a wellsite component, a honing head supported by the base, honing stones supported about the honing head, and a driver. The honing stones are engageable with an outer surface of the tubular component. The driver rotationally drives the honing head whereby the honing stones hone an outer periphery of the tubular component.

31 Claims, 16 Drawing Sheets

(56) References Cited

U.S. PATENT DOCUMENTS

| | | | | | |
|---|---|---|---|---|---|
| 2,238,326 | A * | 4/1941 | Indge | B24B 33/081 | 451/150 |
| 2,245,435 | A * | 6/1941 | Dondineau | B24B 5/423 | 451/181 |
| 2,291,164 | A * | 7/1942 | Law | B24B 33/081 | 451/181 |
| 2,316,422 | A * | 4/1943 | Harris, Jr. | B24B 33/04 | 451/476 |
| 2,474,756 | A * | 6/1949 | Papciak | B24B 33/081 | 451/180 |
| 2,502,381 | A * | 3/1950 | Indge | B24B 33/081 | 451/181 |
| 3,117,401 | A | 1/1964 | Talley | | |
| 3,163,965 | A | 1/1965 | Wheeler | | |
| 3,362,112 | A | 1/1968 | Kirchner et al. | | |
| 4,023,311 | A * | 5/1977 | Naumann | B24B 33/04 | 451/139 |
| 5,341,603 | A * | 8/1994 | Pollock | B24B 5/423 | 451/180 |
| 5,372,430 | A * | 12/1994 | Orndorff, Jr. | B63H 23/326 | 384/116 |
| 5,564,972 | A | 10/1996 | Marvin et al. | | |
| 6,074,282 | A * | 6/2000 | Schimweg | B24B 33/081 | 451/119 |
| 6,585,571 | B2 | 7/2003 | Hyatt et al. | | |
| 8,235,771 | B2 | 8/2012 | Bankovic | | |
| 8,287,214 | B2 * | 10/2012 | Sadaoka | B23B 41/12 | 29/50 |
| 9,233,447 | B2 * | 1/2016 | Shortridge, Sr. | B24B 5/047 | |
| 2002/0037688 | A1 * | 3/2002 | Higashikawa | B24B 33/08 | 451/180 |
| 2014/0057535 | A1 * | 2/2014 | Pohlitz | B24B 33/04 | 451/210 |
| 2015/0321310 | A1 * | 11/2015 | Shortridge, Sr. | B24B 33/086 | 451/49 |

OTHER PUBLICATIONS

Sunnen Honing Techniques, "External Honing", data file #112, Sunnen Products Company, 2006, 12 pages.

PCT/US2015/019287 International Search Report and Written Opinion dated May 29, 2015, 14 pages.

* cited by examiner

APPARATUS AND METHOD FOR HONING TUBULARS OF A WELLSITE

The application claims the benefit of U.S. Provisional Application No. 61/949,862, filed on Mar. 7, 2014, the entire contents of which are hereby incorporated by reference herein.

BACKGROUND

The disclosure relates generally to techniques for machining devices. More specifically, the disclosure relates to techniques for machining and/or honing devices, such as tubulars and/or other tubular components.

Devices, such as pipes, pins, cylinders, tubing, and/or other tubular components or devices, may be used in a variety of applications. In a given example, pipes may be used in oilfield operations to pass fluids to and from various locations, such as from a wellbore to a surface facility. In another example, pins may extend through parts (e.g., machinery) to secure such parts in place.

Such devices may be made of various materials, such as metal, rubber, plastic, and/or other material. The shape of these devices may be specified for a given application. In some cases, these devices may need to be machined to provide a desired shaped and/or to meet a given specification.

Machining tools, such as drills, grinders, sanders, etc., may be used to machine devices into a desired shape. Examples of tools are provided in U.S. Pat. Nos. 6,074,282 and 2,474,756, the entire contents of which are hereby incorporated by reference herein.

SUMMARY

In at least one aspect, the disclosure relates to a tool for honing a tubular component of a wellsite. The honing tool includes a base operatively connectable to a wellsite component, a honing head supported by the base, honing stones supported about the honing head, and a driver. The honing stones are engageable with an outer surface of the tubular component. The driver rotationally drives the honing head whereby the honing stones hone an outer periphery of the tubular component.

The honing tool may also include a mounting plate and/or a bracket. The driver may axially drive the honing head. The honing head may have tubular body with a stop plate at an end thereof, the honing head having a cavity to receive the tubular component therein. The honing stones may be positioned about an inner surface of the honing head. The honing stones may include three honing stones spaced equally about an inner periphery of the honing head. The honing tool may also include supports to support the honing stones in the honing head. The supports may include comprises at least one of a platform, a rod, a spring, a collar, and an adjustment screw. The honing tool may also include a stop positionable in the honing head, the stop comprising a wear disk engageable by the pin. The base may be operatively connectable to the wellsite component, the wellsite component having the tubular component mounted thereabout. The wellsite component may be a tubing, riser, flange, and/or a workbench. The tubular component may also include pins of a riser.

In another aspect, the disclosure relates to an assembly for honing a tubular component of a wellsite. The honing assembly may also include a honing tool and a mount. The honing tool includes a base operatively connectable to a wellsite component, a honing head supported by the base, honing stones supported about the honing head, and a driver. The honing stones are engageable with an outer surface of the tubular component. The driver rotationally drives the honing head whereby the honing stones hone an outer periphery of the tubular component. The mount operatively connects the honing tool to the tubular.

The honing assembly may also include connectors to secure the mounting plate to the tubular. The mount may include a mounting plate and/or a mounting wheel. The mount may also include clamps and/or handles. The honing assembly may also include an adjuster adjustably connecting the base to the mounting plate. The mount may have slots therein and the adjuster may include a bracket slidably movable about the slots. The adjuster may include a plate operatively connectable to the base and rods slidably extendable therefrom, with the rods operatively connectable to the mount. The honing assembly may also include a fluid source extending into the honing head and/or a centering jig positionable in the honing head. The centering jig may have inlets defining a position of the honing stones in the honing head.

Finally, in another aspect, the disclosure relates to a method of honing a tubular component of a wellsite. The method involves providing a honing tool comprising a base and a honing head, adjustably positioning honing stones in the honing head, mounting the honing tool about a wellsite component, disposing the honing head about the tubular component, and rotating the honing head.

The method may also include axially moving the honing head along the tubular. The operatively connecting may involve operatively connecting the base to the tubular with a mount and an adjuster. The disposing may involve centering the honing stones about an inner periphery of the honing head, adjustably positioning the honing stones in the honing head, disposing comprises springingly supporting the honing stones about an inner periphery of the honing head, axially moving the honing head about the tubular component, and/or terminating the axially moving with a stop.

BRIEF DESCRIPTION DRAWINGS

So that the above recited features and advantages can be understood in detail, a more particular description, briefly summarized above, may be had by reference to the embodiments thereof that are illustrated in the appended drawings. It is to be noted, however, that the appended drawings illustrate only typical embodiments and are, therefore, not to be considered limiting of its scope. The figures are not necessarily to scale and certain features and certain views of the figures may be shown exaggerated in scale or in schematic in the interest of clarity and conciseness.

Figure 5A:
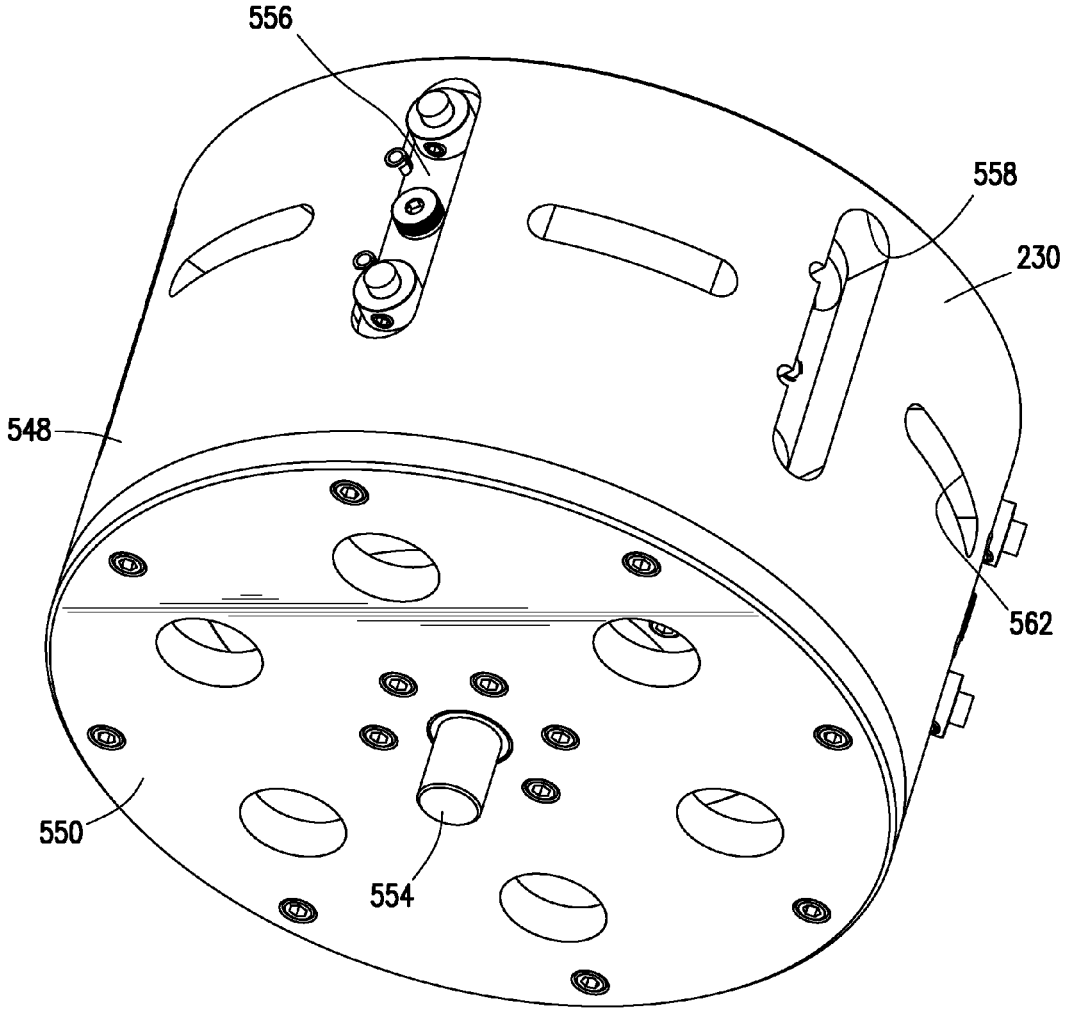
Figure 5B:
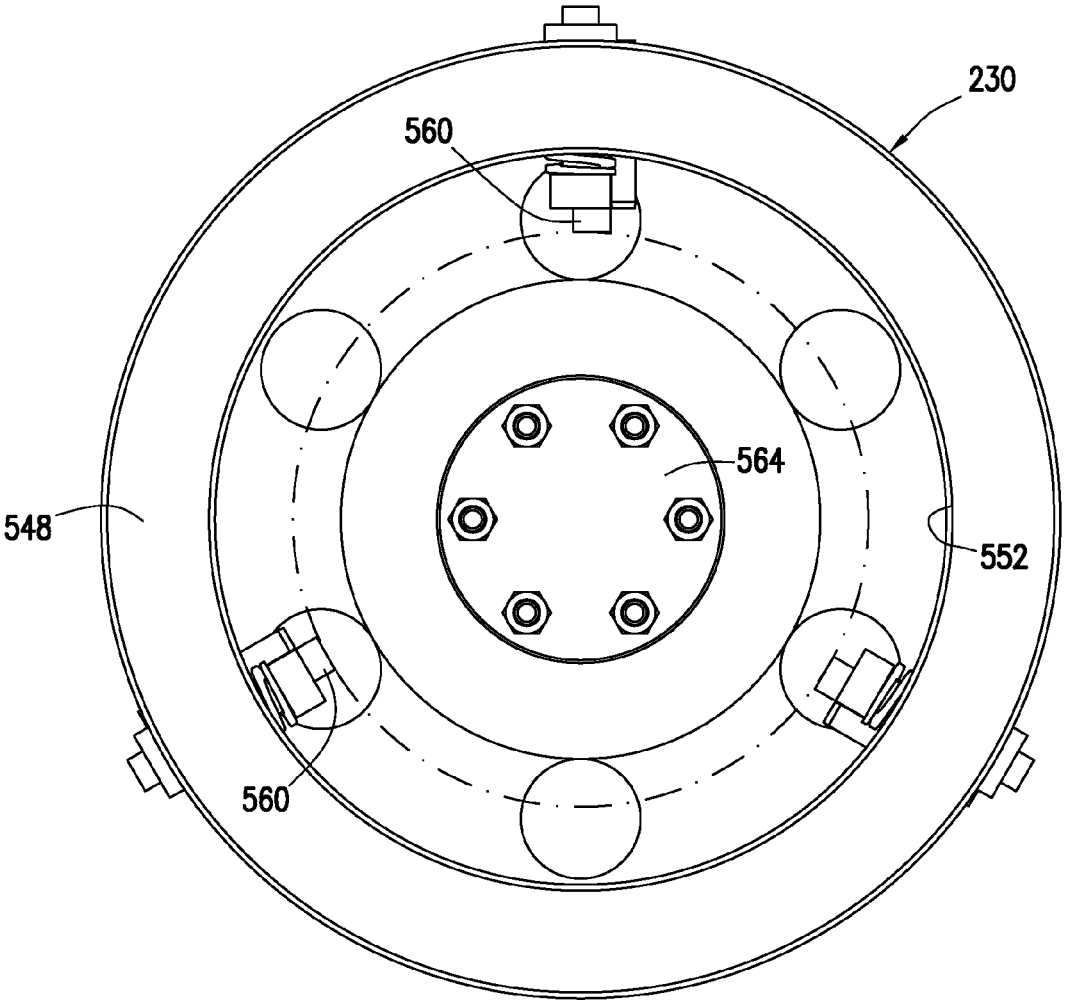

FIGS. 5A and 5B perspective and end views of a honing head of the honing tool.

Figure 6:
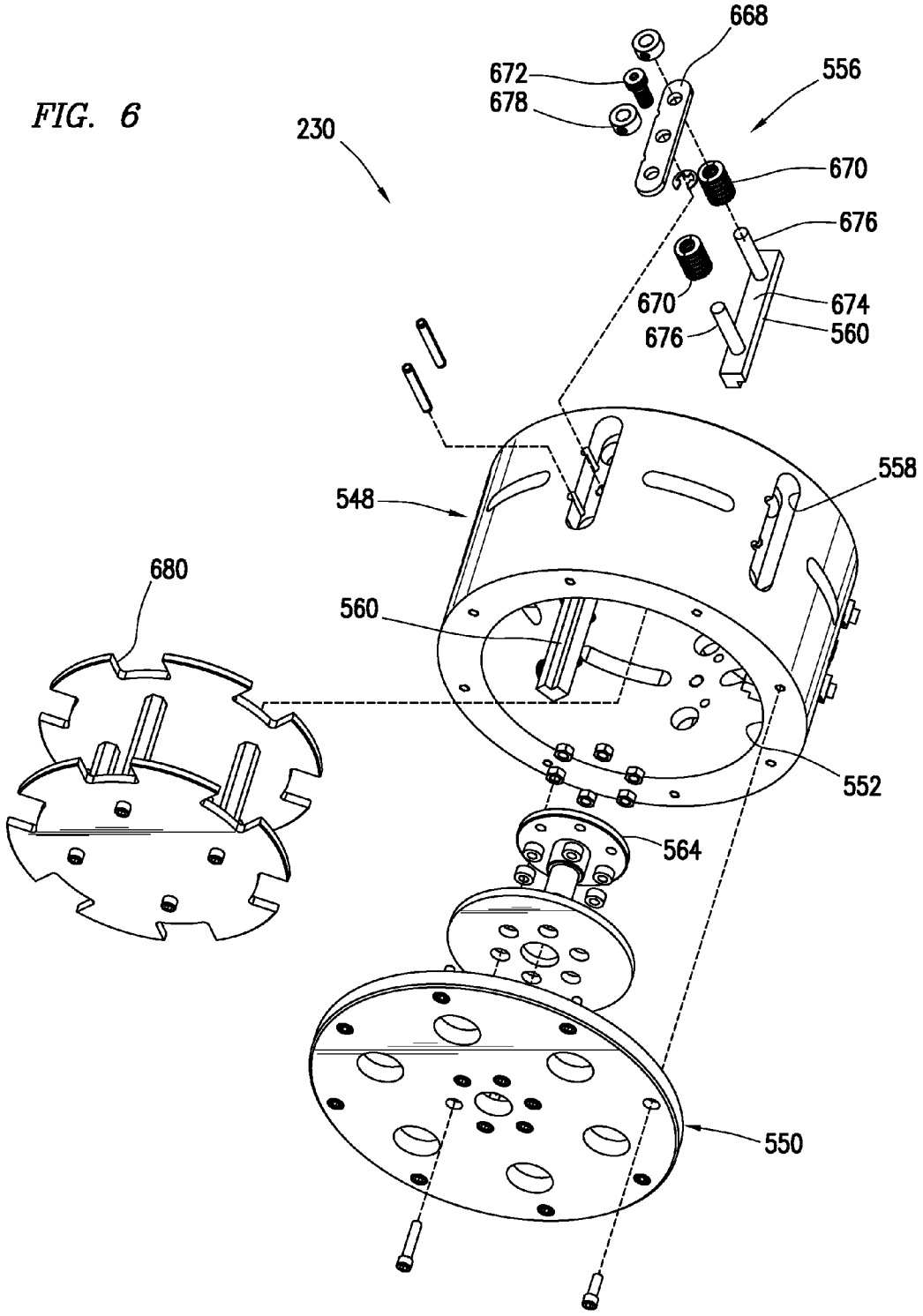

FIG. 6 is an exploded view of the honing head and a centering jig.

Figure 7A:
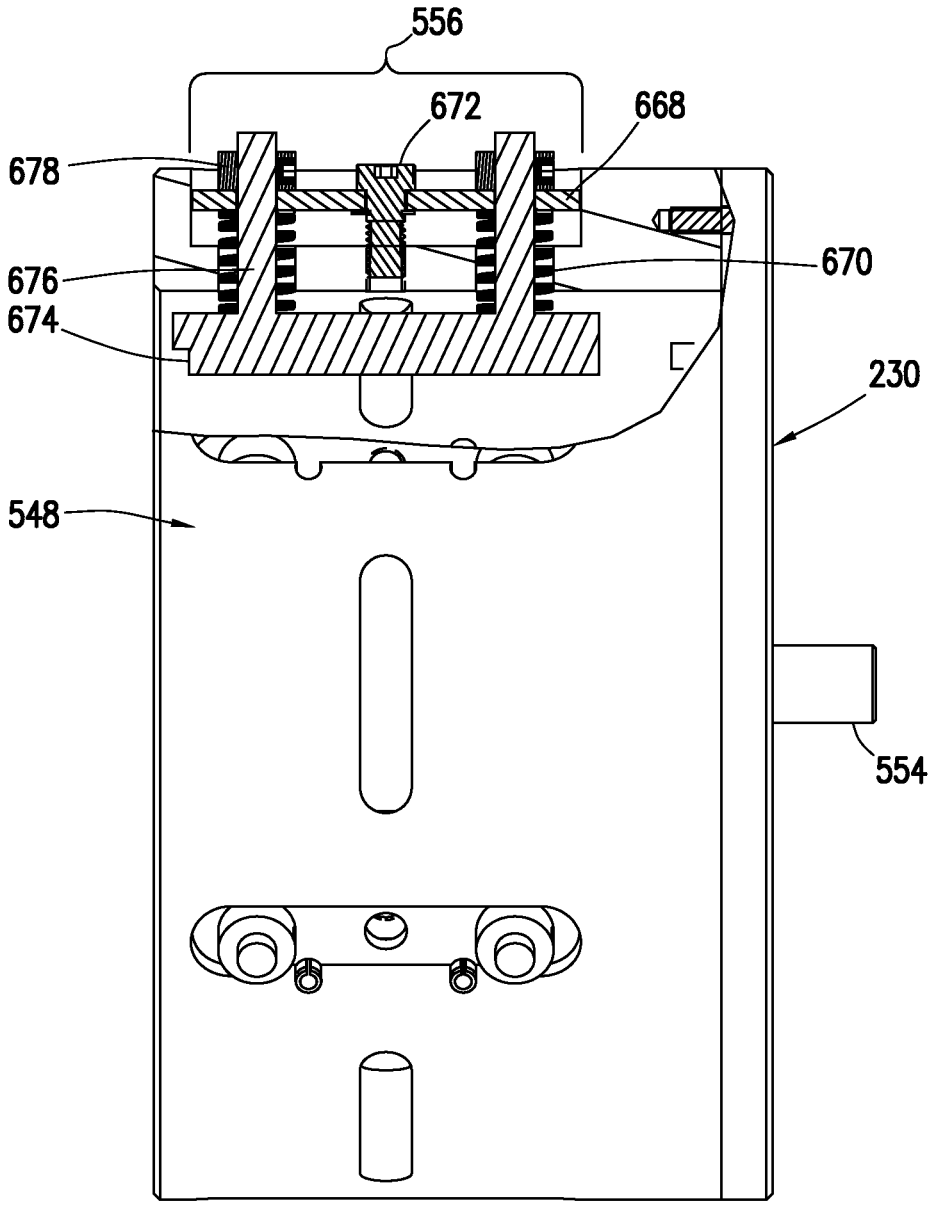
Figure 7B:
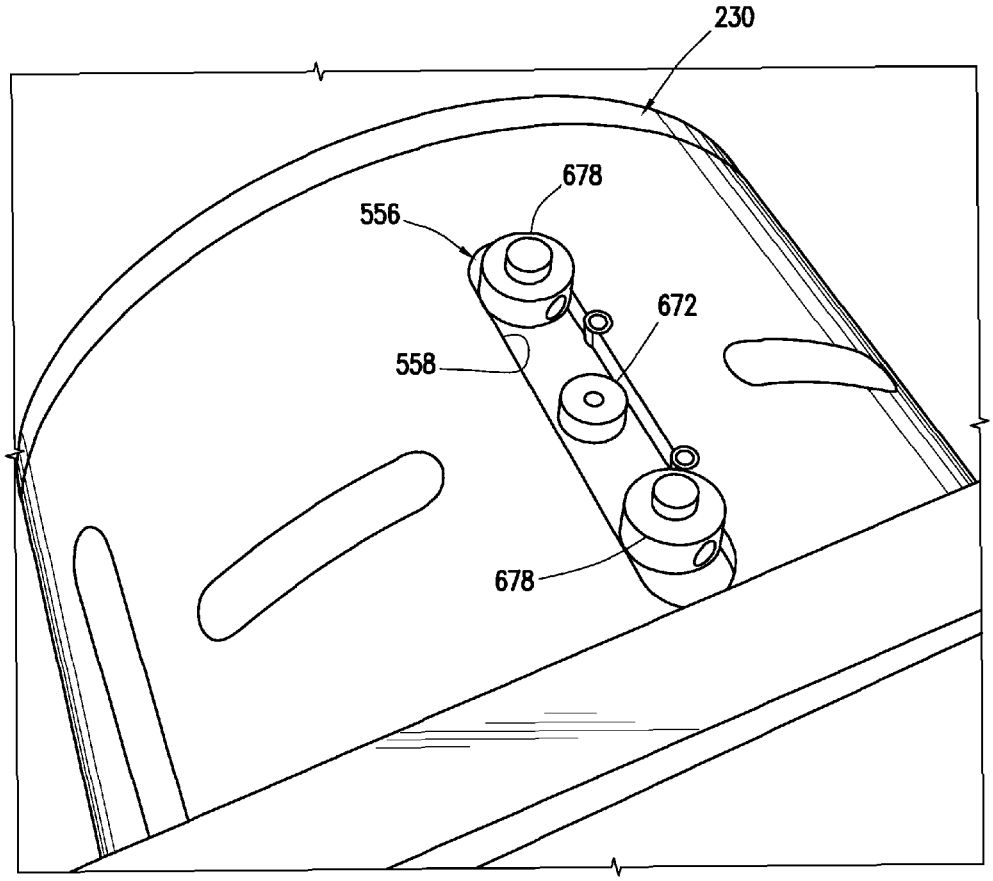

FIGS. 7A and 7B are a side view (partially in cross-section) and a perspective view, respectively, of the honing head having honing stone assemblies.

Figure 8A:
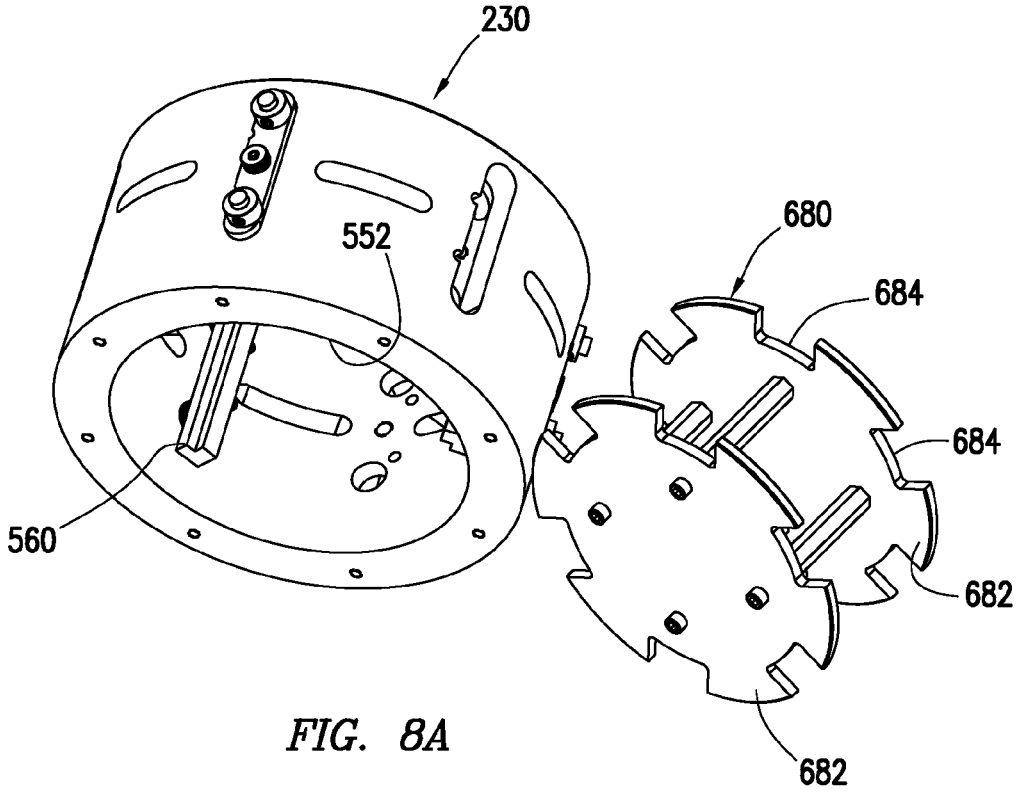
Figure 8B:
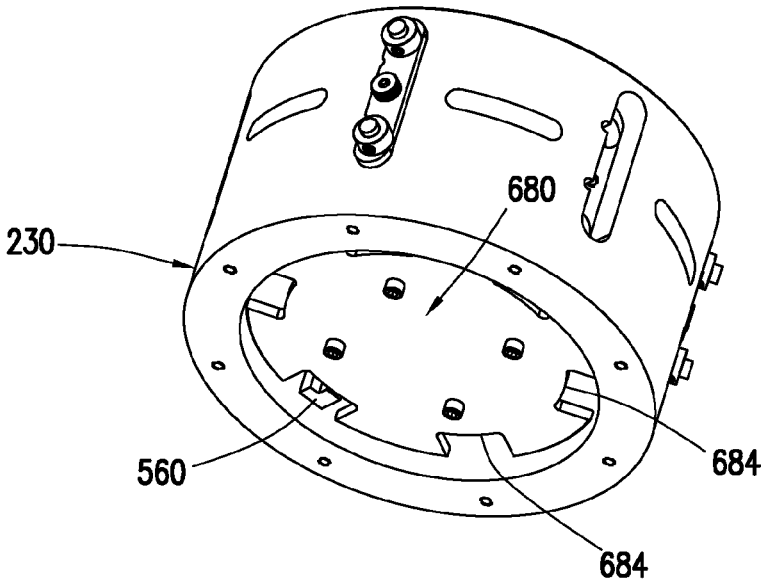

FIGS. 8A and 8B are perspective views of the honing head with a centering jig in an uninstalled and an installed position, respectively.

Figure 9:
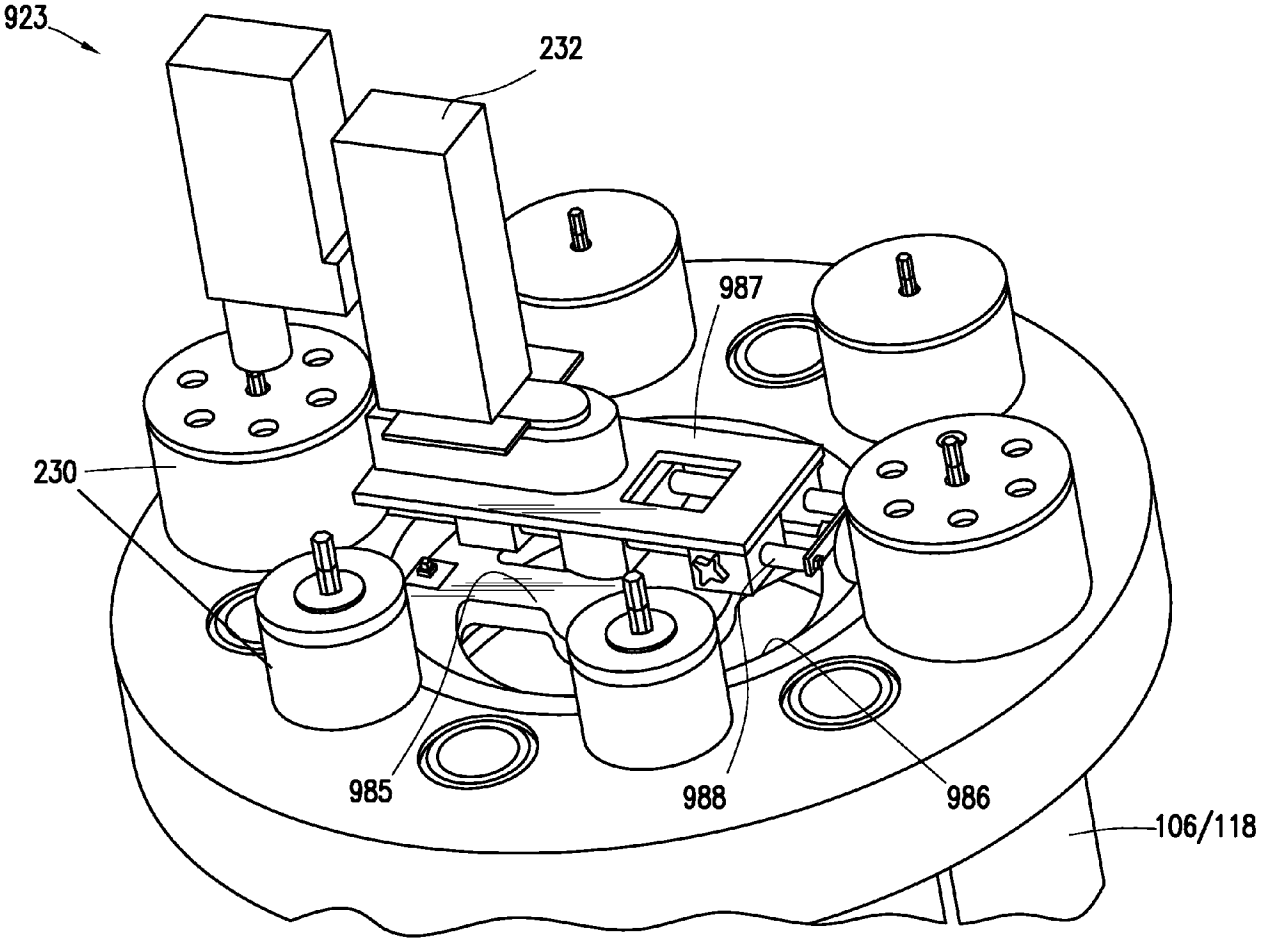

FIG. 9 is a schematic perspective view of another honing tool positioned about the tubing of the riser.

Figure 10A:
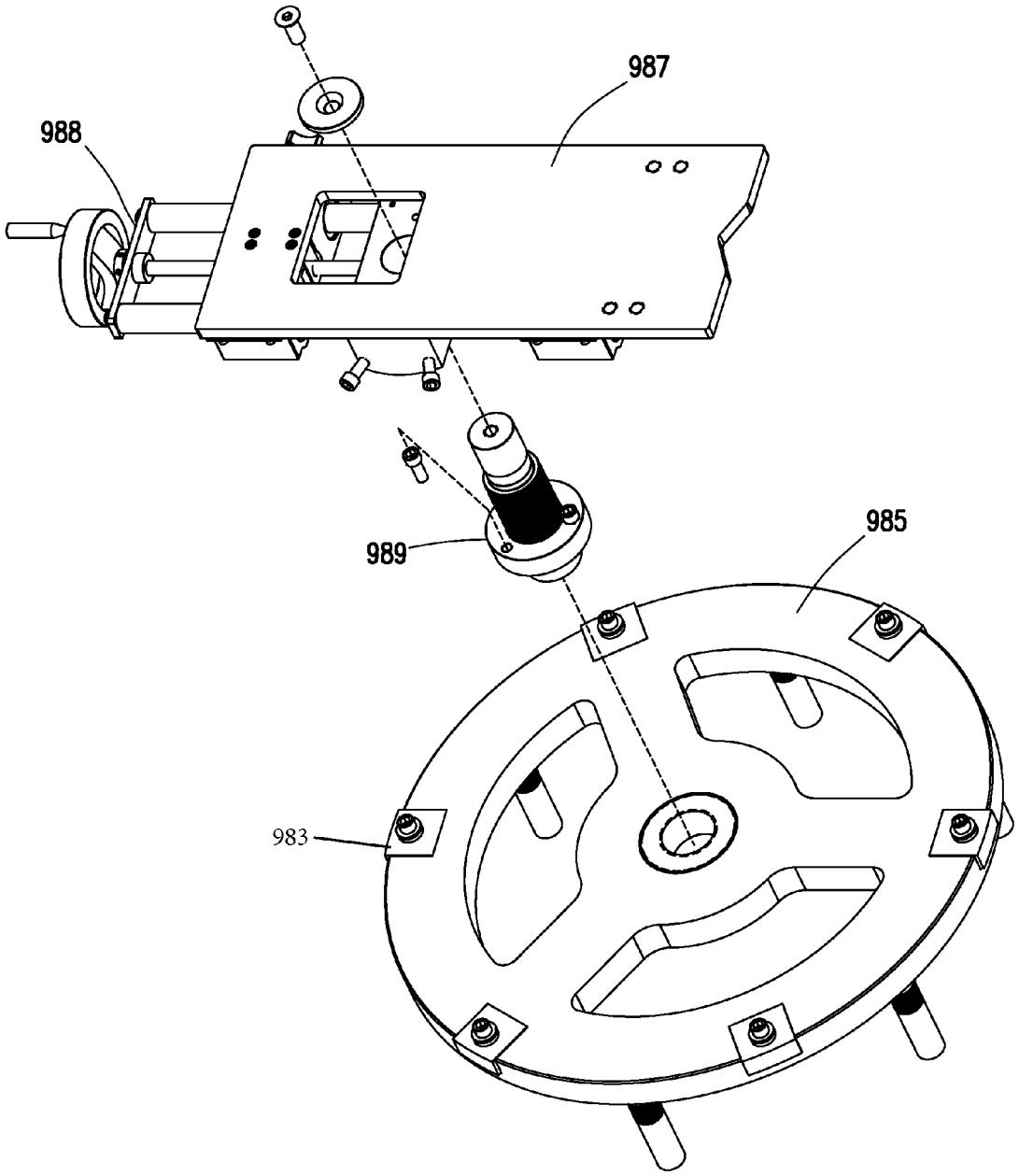
Figure 10B:
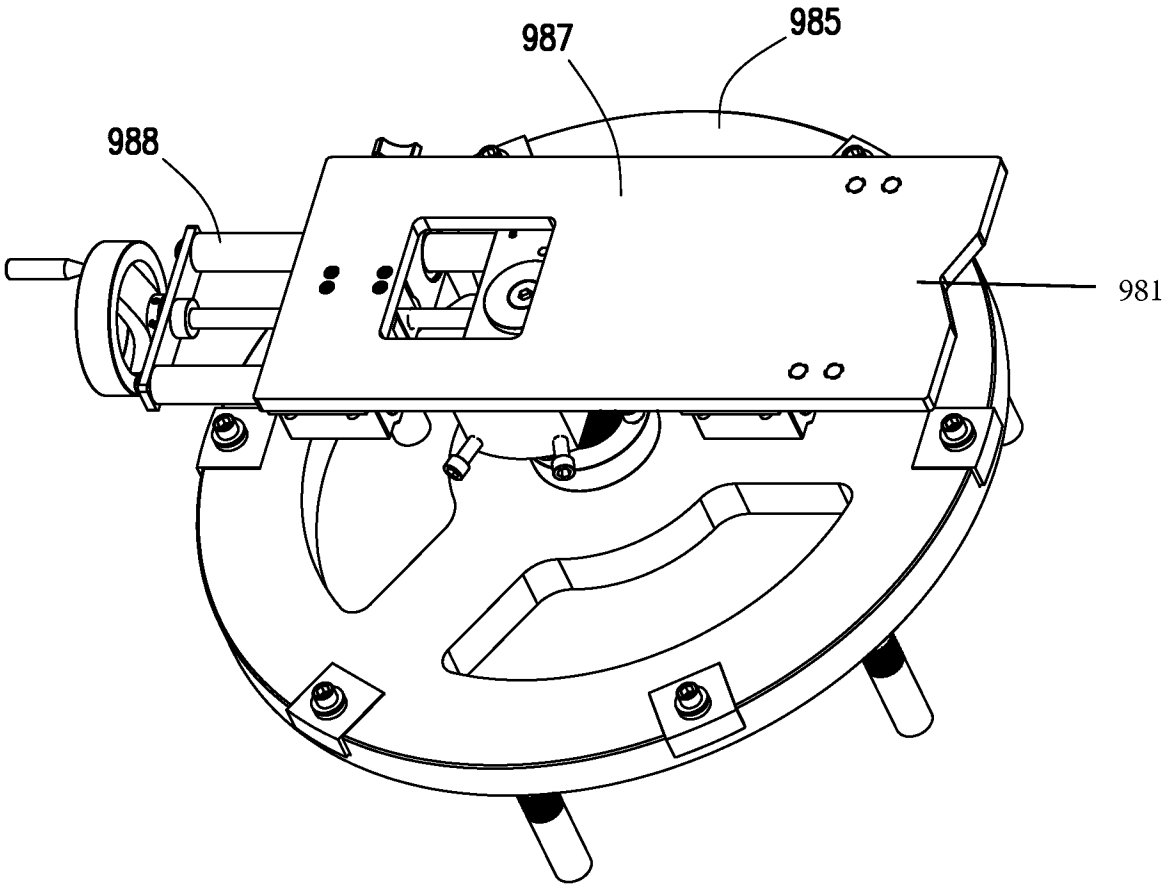

FIGS. 10A-10B are additional views of portions of the honing tool of FIG. 9.

Figure 11:
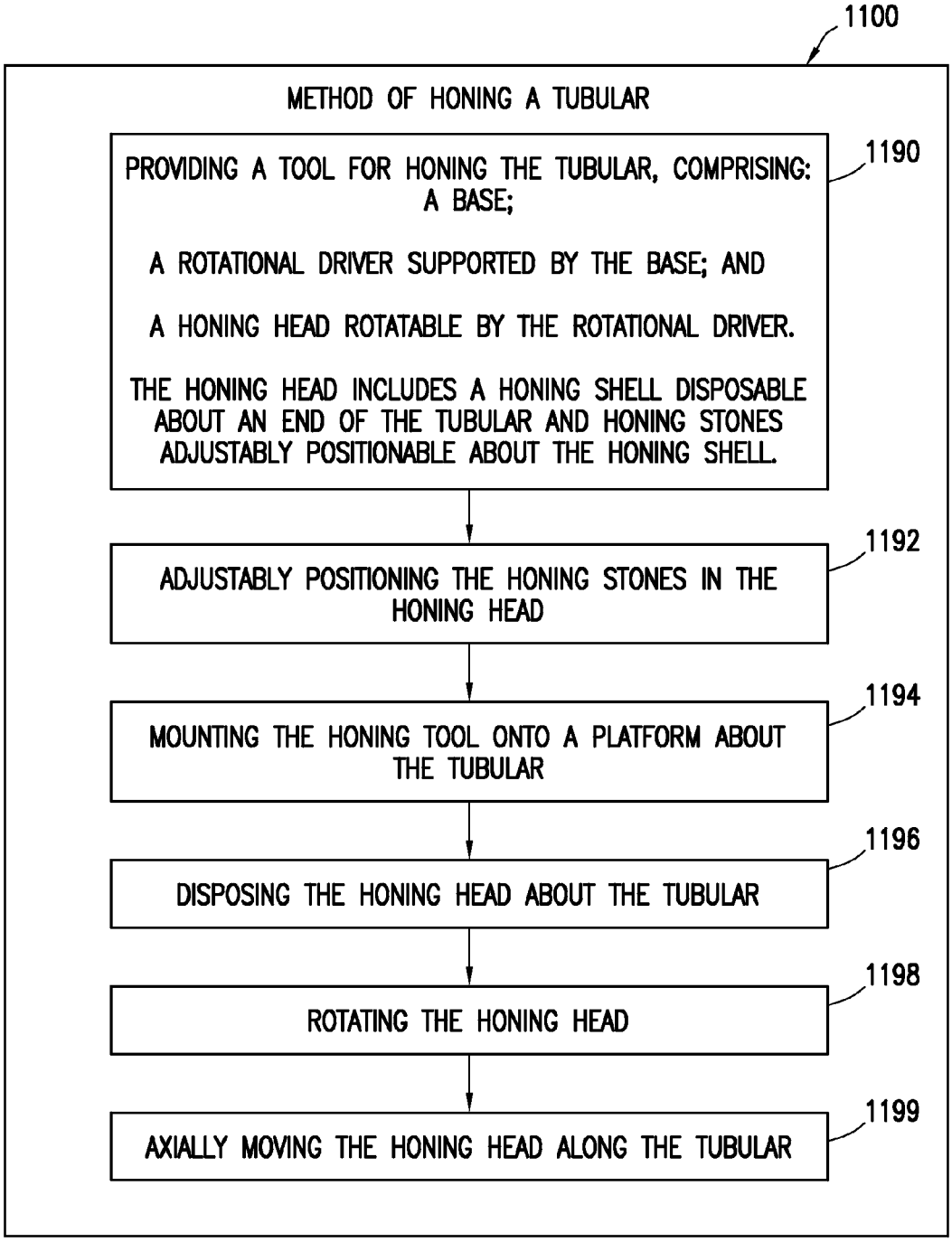

FIG. 11 is a flow chart depicting a method of honing a tubular of a wellsite.

DETAILED DESCRIPTION

The description that follows includes exemplary systems, apparatuses, methods, and instruction sequences that embody techniques of the inventive subject matter. However, it is understood that the described embodiments may be practiced without these specific details.

A honing tool for honing (e.g., grinding, polishing, smoothing, sanding, finishing, shaving, etc.) an outer diameter of a tubular component (e.g., a pipe, pin, cylinder, tubing, tubular, and/or other device) is provided. The honing tool includes a rotationally driven honing head with honing stones therein. The honing head is positionable about the tubular with the honing stones radially disposed thereabout. The honing stones hone an outer surface of the tubular as the honing head is rotationally driven thereabout.

The honing stones may be spring-loaded in the honing head on a honing support, and adjustably positionable relative to the tubular. The depth of the honing stones may be adjusted to center the tubular therebetween and/or to apply a desired amount of grinding force onto the outer diameter of the tubular. The honing stone may be rotated about a fixed tubular and/or a rotating tubular may be positioned in a fixed honing stone. The honing tool may be used at a workbench and/or mounted onto equipment for honing onsite. The honing tool may be mounted using a mount, such as a mounting plate or a mounting wheel with or without adjustable brackets.

Figure 1:
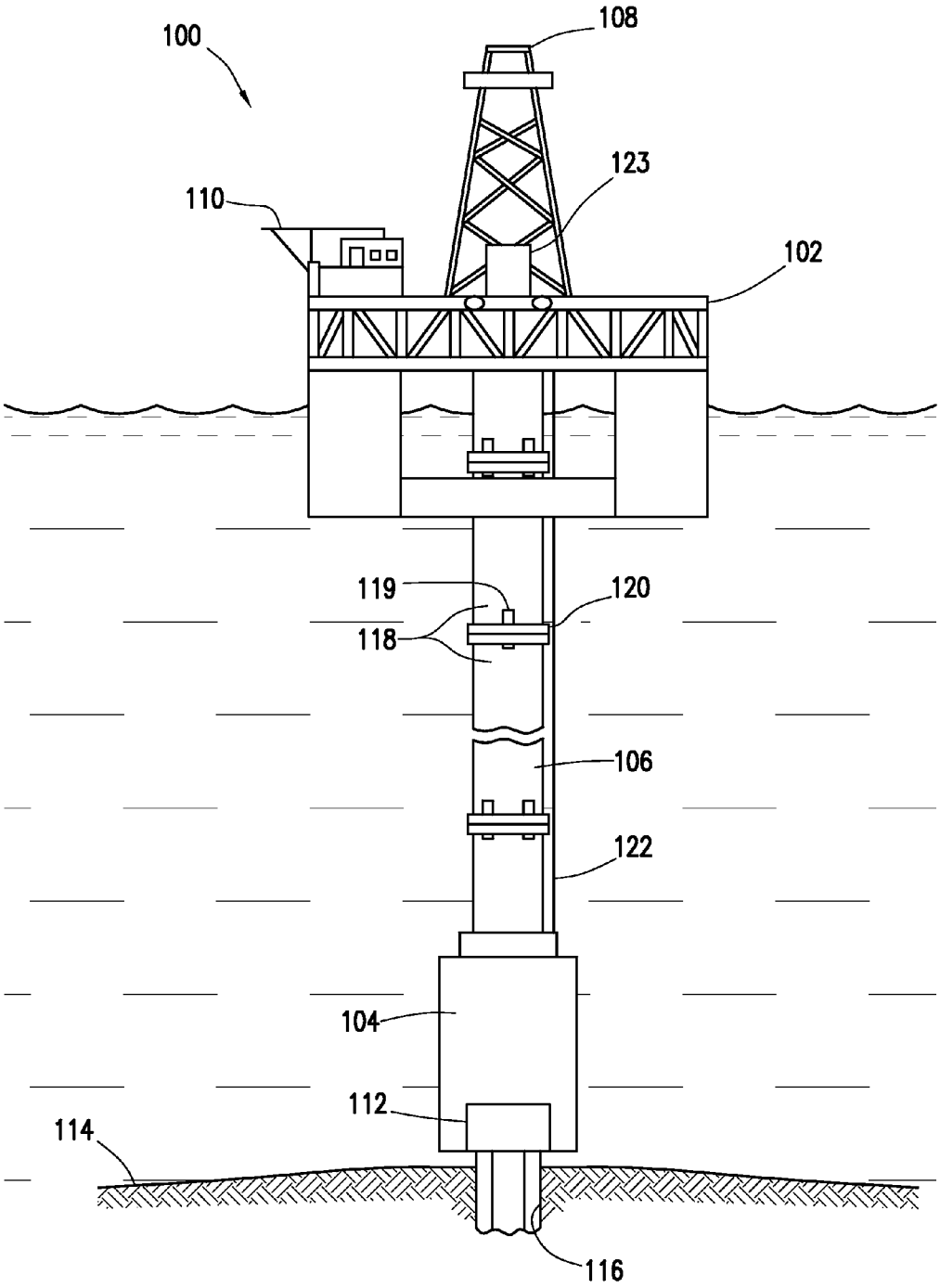
FIG. 1 is a schematic view of an offshore wellsite having a riser extending from a surface platform to subsea equipment, and a honing tool to hone pins connecting adjacent tubing of the riser.

FIG. 1 depicts an example environment in which subject matter of the present disclosure may be utilized. This figure depicts a wellsite 100 having a platform 102 and subsea equipment 104, with a riser 106 therebetween. The platform 102 has a rig 108 and other surface equipment 110 for operating the wellsite 100.

The subsea equipment 104 is positioned about a wellhead 112 located on sea floor 114 adjacent a wellbore 116. The subsea equipment 104 is schematically depicted as a box adjacent the wellhead 112, but may be positioned about the sea floor 114 and may include various subsea components, such as strippers, blowout preventers, manifolds and/or other subsea devices for performing subsea operations.

The riser 106 joins the rig 108 on the platform 102 to the subsea equipment 104 on the sea floor 114. The riser 106 may be used, for example, as a means for transporting fluids between the wellbore 116 and the platform 102. The riser 106 may be, for example, a drill through umbilical line between the subsea equipment 104 and the rig 108 at the surface.

The riser 106 is made up of a series of adjacent tubing 118 with flanged ends joined by pins 119 (and/or bolts) to form tubing connections 120 therebetween. The tubing 118 may be, for example, tubing having a length of about 75 feet (22.86 m) in length. The tubing connections 120 may also support one or more of the conduits 122 in a desired configuration about the riser 106. The tubing 118 and the tubing connections 120 may be configured to support the riser 106 in position in subsea conditions.

The surface equipment 110 may include equipment, such as a control room capable of performing various functions, such as processing, control and/or communication equipment for operation of the wellsite 100. The surface equipment may be used to send/receive data, communication and/or control signals to/from various portions of the wellsite 100. The surface equipment may also include a honing tool 123 used for honing tubulars, such as pins 119 as will be described further herein.

While FIG. 1 show pins 119 of the riser 106 to be honed by the honing tool 123 at the wellsite 100, it will be appreciated that the honing tool 123 may be used with the pins 119, and/or other tubulars, and/or may be used with a variety of applications involving wellsite (land-based or offshore) and/or non-wellsite applications.

Figure 2:
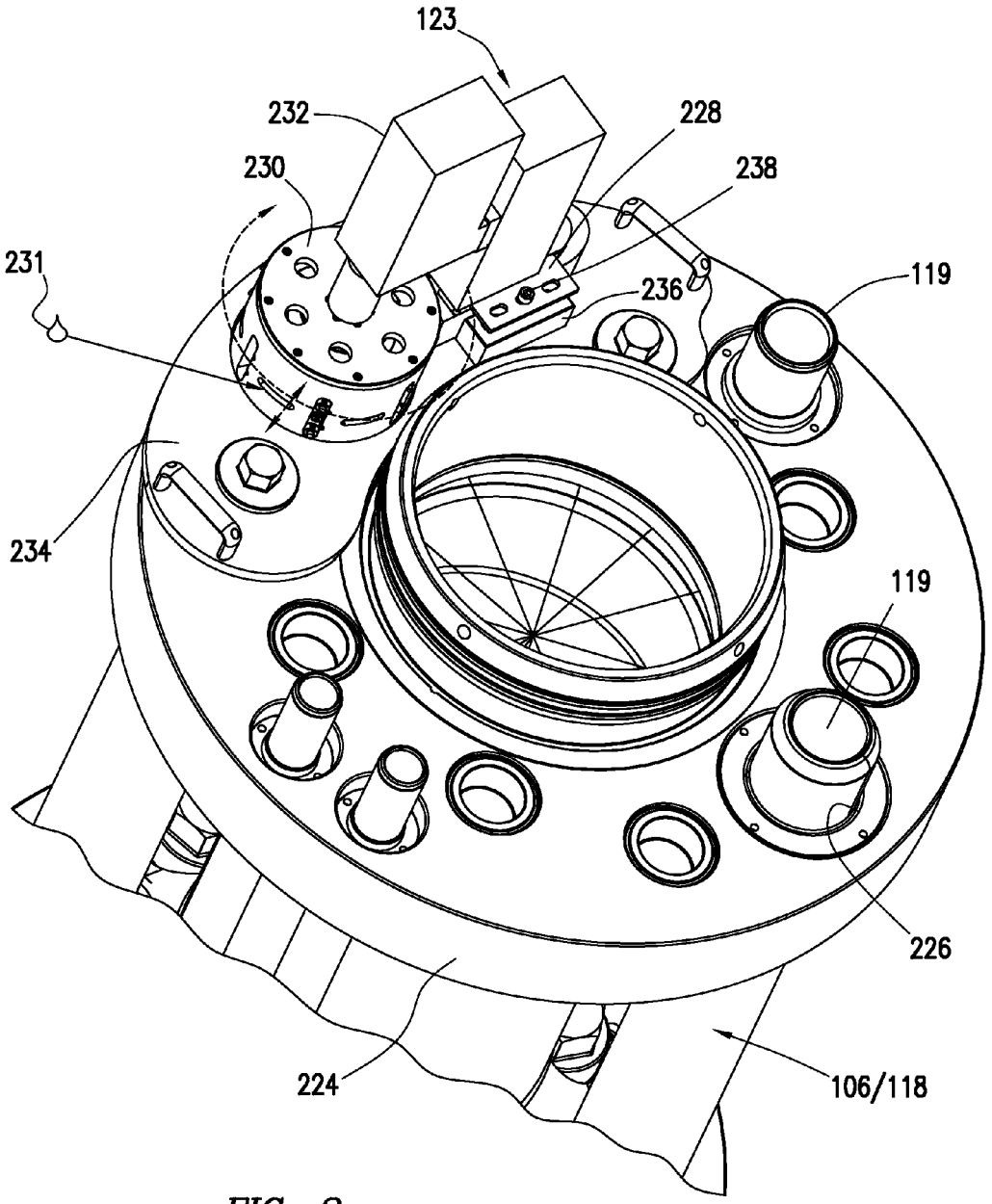
FIG. 2 is a schematic perspective view of a tubing of a riser with a honing tool thereon.
Figure 3A:
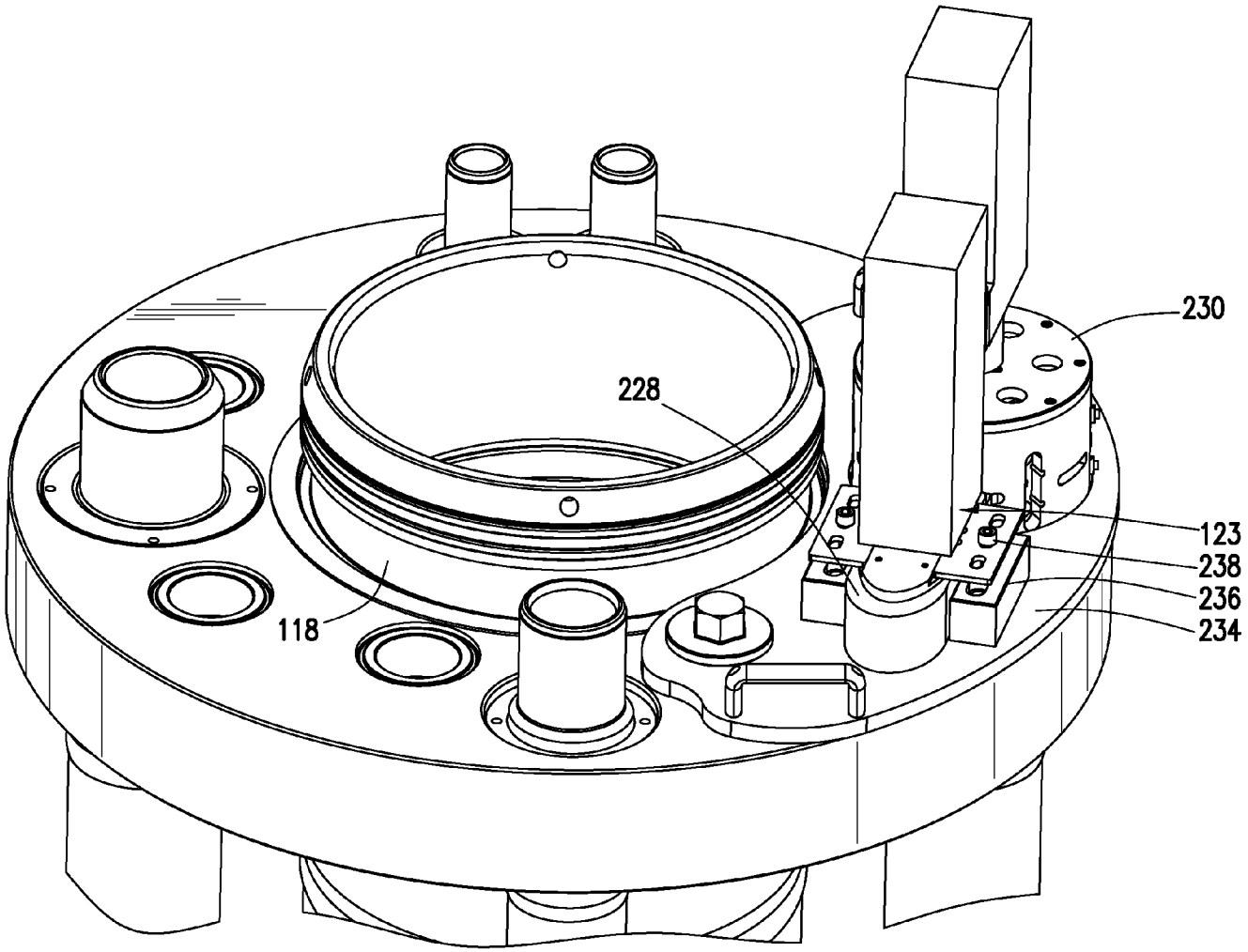
FIGS. 3A-3C are additional schematic views of the tubing with the honing tool thereon.
Figure 3B:
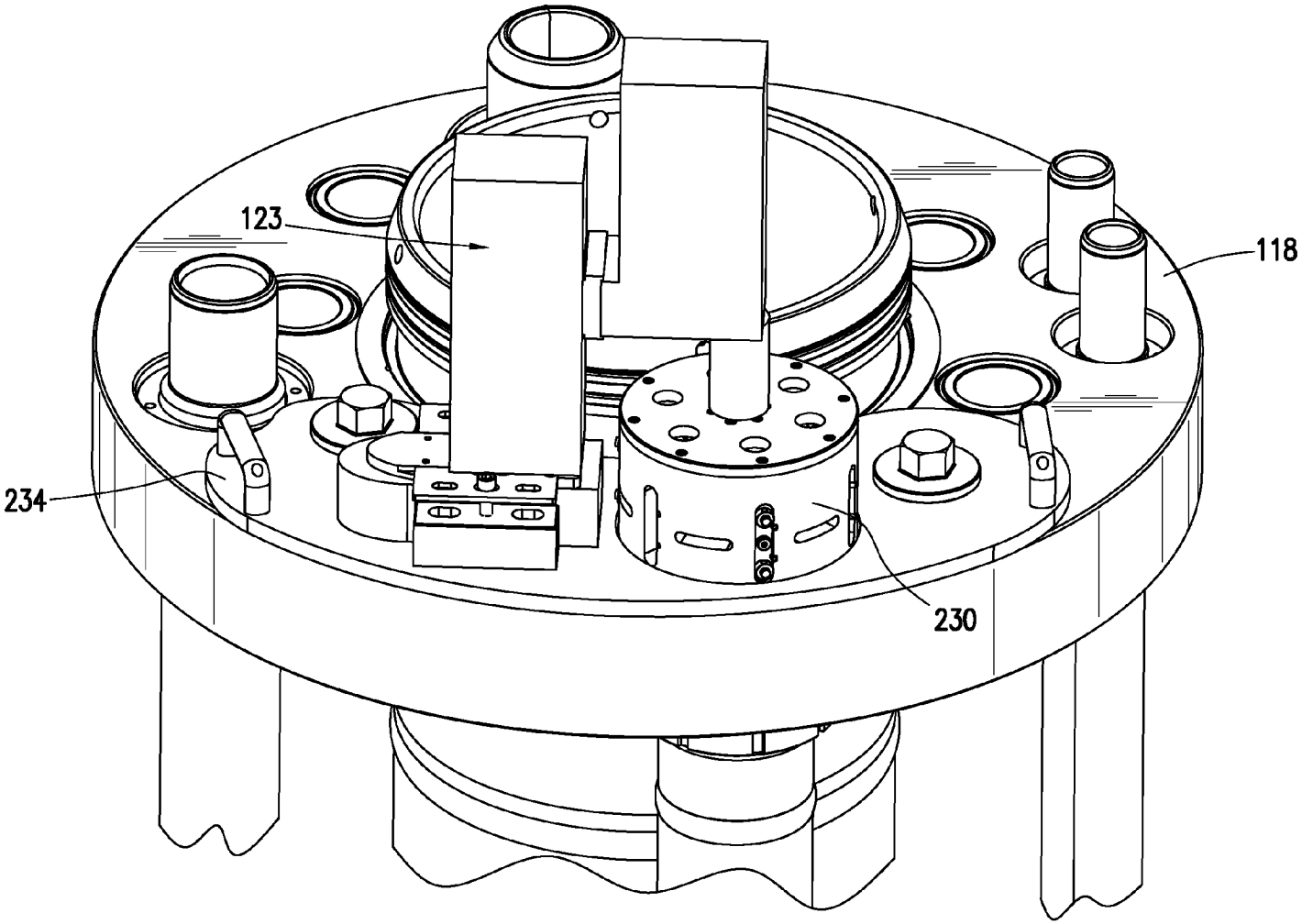
Figure 3C:
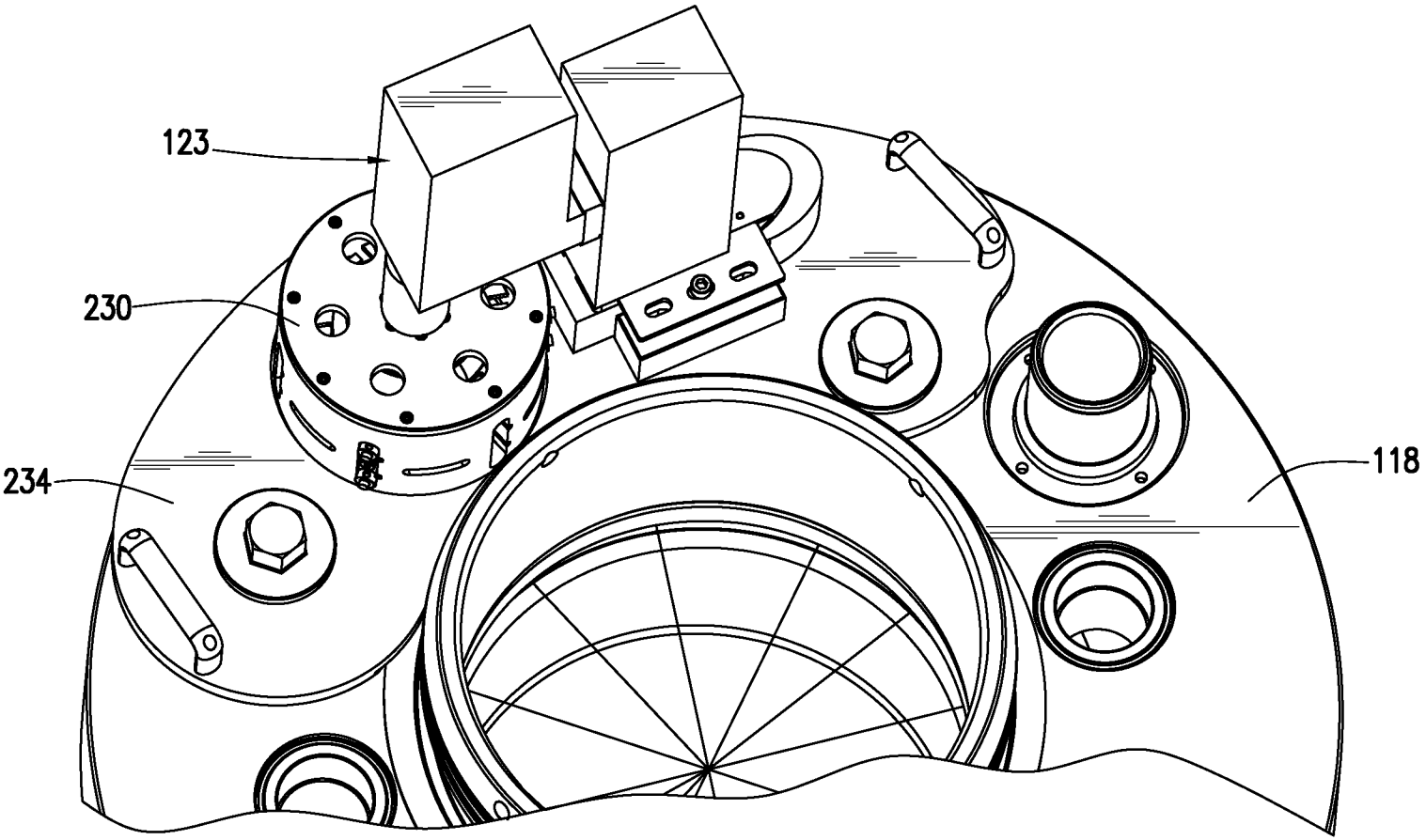

FIG. 2 shows a schematic view of a portion of the tubing 118 and pins 119 of FIG. 1. FIGS. 3A-3C show additional schematic views of the tubing 118 and pins 119. As shown in these Figures, the honing tool 123 is positioned on a flanged end 224 of the tubing 118 to hone one of the pins 119 extending through pin holes 226 in the tubing 118. The honing tool 123 may be positioned on the tubing 118 to hone the pin 119 while in place on the riser 106, or removed therefrom.

The pin 119 may be honed by the honing tool 123 while installed in the tubing 118, removed from the tubing 118, at the wellsite 100 (FIG. 1), and/or at another location. By way of example, the pin 119 may be removed from the tubing and honed with the honing tool 123 at a work bench or other location.

The honing tool 123 includes a base 228 supported on the tubing 118, a honing head 230 supported by the base 228, and a driver 232. The driver 232 is carried by the base 228 and drives the honing head 230. The driver 232 may rotationally and axially drive the honing tool 123. The honing head 230 may be selectively advanced and retracted along the pin 119. A fluid source 231 may optionally be provided to apply fluid into the honing head 230 during honing.

In the example shown, the honing tool 123 is mounted onto an end of the tubing 118 and disposed onto the pin 119, but could be mounted on other wellsite components. As depicted, the honing tool 123 may be mounted on the tubing 106 by a mount in the form of a mounting plate 234 and an adjuster in the form of a bracket 236. As shown, the mounting plate 234 may be secured to flange end 224 of the tubing 118. The bracket 236 may be supported on the mounting plate 234 to receive the honing tool 123. The base 228 may be provided with connectors 238 for connecting to the mounting plate 234 with bracket 236 and/or mounting plate 234.

Figure 4A:
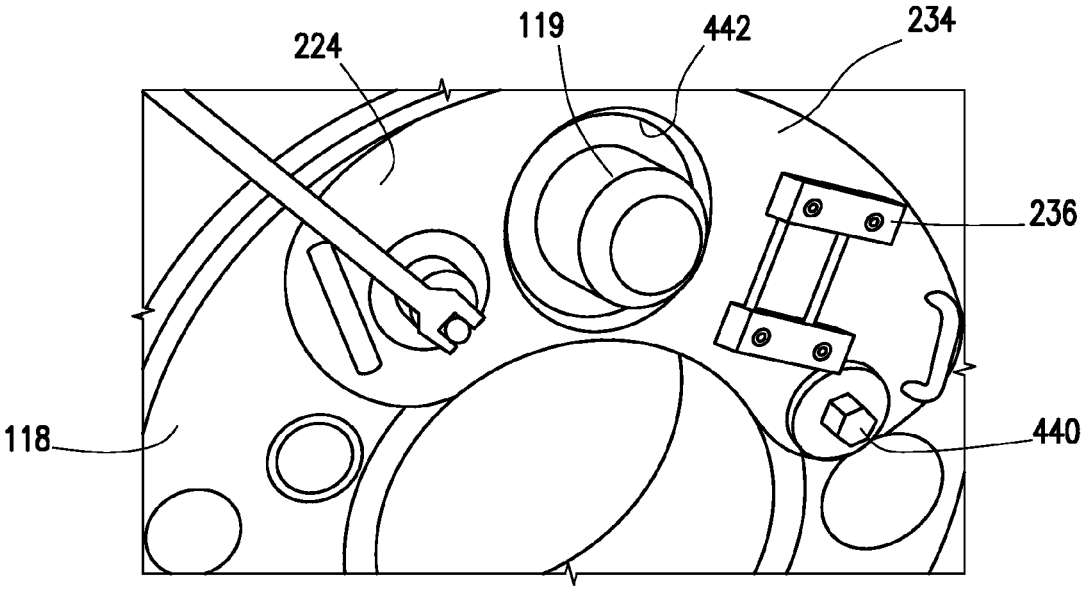
FIGS. 4A and 4B are perspective and top views of a mounting plate usable with the tubing and the honing tool.
Figure 4B:
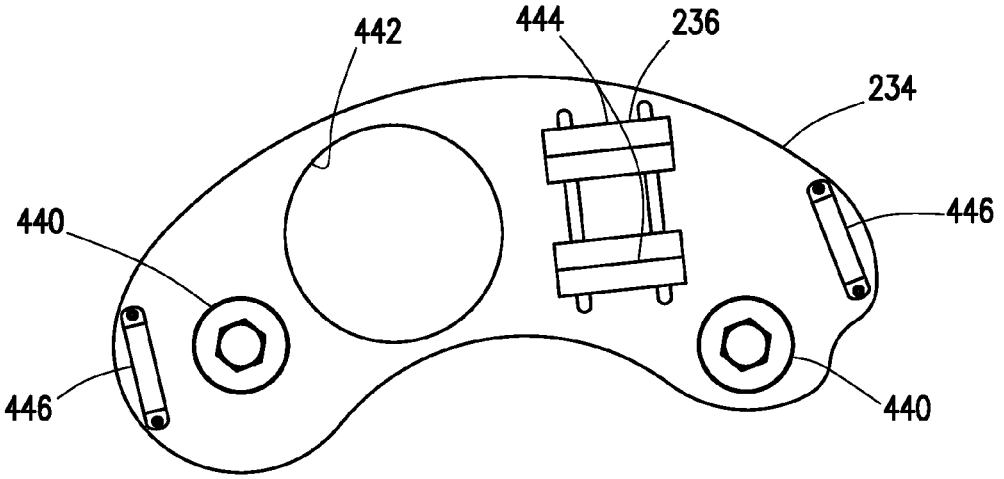

FIGS. 4A and 4B show alternate views of an example configuration of the mounting plate 234. As shown in FIG. 4A, the mounting plate 234 is positioned on the flange end 224 of tubing 118 with the pin 119 extending therethrough. FIG. 4B shows the mounting plate 234 removed from the tubing 118. As shown, the mounting plate 234 is a curved plate secured to the end of the tubing 118. The mounting plate 234 is connectable to the tubing 118 by bolts 440. The mounting plate 234 has a pin hole 442 to receive the pin 119 when connected to the tubing 118.

The bracket 236 is positioned on a surface of the mounting plate 234. The bracket 236 includes a pair of sliding clamps 444 slidably positionable in channels in the mounting plate 234. The clamps 444 of the brackets 236 may be adjusted along the channels to grippingly receive the honing tool 123. The clamps 444 may have connectors to connect to the base 228 and/or connector 238 of the honing tool 234 as shown in FIG. 2. Handles 446 may also be provided to transport the mounting plate 234.

FIGS. 5A and 5B and 6 depict an example configuration of the honing head 230. As shown in these views, the honing head 234 includes a tubular body 548 with a stop plate 550 at an end thereof. A cavity 552 is defined in the tubular body 548 to receive tubulars, such as the pin 119 for honing. The stop plate 550 supports a drive shaft 554 therein. The shaft 554 is connectable to the driver 232 (FIG. 2) for rotation thereby. A spacer may optionally be provided to distance the drive shaft from the stop plate 550.

The honing head 230 has honing stone assemblies 556 supported in channels 558 radially disposed about the honing head 230. The honing stone assemblies 556 include honing stones 560 extending into an inner surface of the tubular body 548. One or more honing stone assemblies 556 may be provided about the tubular body 548 to engage and hone a tubular positioned therein. As shown, three honing stones 560 are disposed equidistance about the tubular body 548, but any arrangement of one or more honing stones 560 may be used.

As shown in FIG. 5B, the honing stones are positioned at 120 degrees about the inner diameter of the honing head 230. The placement of the honing stones may be used to center the tubular as it is received into cavity 552. The honing stones 560 positioned in cavity 552 may define adjustable honing diameters of a desired diameter, such as from about 1.5 inches (3.81 cm) to about 12.00 inches (30.48 cm).

The honing head 230 is also optionally provided with a variety of features. For example, the tubular body 548 has slots 562 therethrough. The slots 562 may be used to receive fluid from fluid source 236 (FIG. 2) therethrough. A stop 564 may be provided along stop plate 550 to terminate advancement of the honing head 230 during use. The stop 564 may include a wear disk with a protective material to prevent damage to an end of the tubular. As the honing head 230 moves axially along the tubular, the stop 564 may engage the tubular and terminate axial advancement of the honing head 230 along the tubular.

As shown in FIGS. 6, 7A, and 7B, the stop plate 550 may include multiple portions with connectors. Stop 564 may be positioned on an inner surface of the stop plate 550. The honing stone assembly 556 includes a honing support (or tension plate) 668, springs 670, and an adjustment screw 672. The honing stone assembly 556 is positionable in the channel 558 of the honing head and extendable therethrough to support the honing stone 560.

The honing stone 560 may be a device with an abrasive surface capable engaging an outer surface of a tubular, for example for honing (e.g., grinding, polishing, smoothing, sanding, finishing, shaving, etc.) the outer surface. Honing stones and/or honing sets usable as the honing stones 560 are commercially available from TENNESSEE ABRASIVE™ at http://www.tennesseeabrasive.com/.

The honing stones 560 as shown include an abrasive surface supported on a platform 674 with rods 676 disposable through holes in the channel 558. The springs 670 are positionable about the rods 676. The support 668 has holes therethrough to receive the rods 676 and compress the springs 670 against the platform 674. Collars 678 are threadedly connectable to the rods 676 to secure the honing stones 560, support 668, and springs 670 in the channel 558.

Adjustment screw 672 is threadedly disposable through the channel 558 and the support 668 to adjust the distance of the support 668 from the platform 674 and the compression of the springs 670. The adjustment screw 672 may retain the support 668 in position, and provide the springs 670 with means to adjust tension of the springs to the outer diameter of the tubular. The springs 670 may be used to provide for spring-loaded force of the honing stones 560 against the tubular and/or to compress the honing stones 560 against the tubular.

The adjustment screw 672 and/or collars 678 may be selectively tightened about the support 668 to adjust the operation of the grinding stone 674. In an example, the grinding stones 674 may be positioned along an inner surface of the honing head 230 and extend through a wall of the honing head 230 at channels 558. The support 668 is disposed onto the rods 676 and inserted into the channel 558. Collars 678 may be threadedly disposed onto the rods 676 to secure the support 668 and honing stones 674 to the honing head 230.

The adjustment screw 672 may then be disposed through support 668 and into the wall of the honing head 230 and tightened therein. The adjustment screw 672 may be tightened to a desired position as indicated by a point on the adjustment screw 672 relative to a marker on the honing head 230. Once the adjustment screw is secured into place, the adjustment screw 672 may be torqued an additional amount relative to the marker.

The adjustment screw 672 may be rotationally advanced to selectively adjust the extension of the honing stones 560 into the cavity 552. This adjustment may also determine the force of the honing stone 560 against the tubular and the amount of abrasive force applied thereto. This adjustment may also determine position of the various honing stones 560 within the cavity 552 which determines the position and/or centering of the tubular within the honing head 230.

The springs 670 and/or the adjustability of the honing stones 560 may be used to overcome centrifugal forces on the honing stones 560 as the honing head 230 rotates about the tubular and as the diameters increase during honing. Initially, the honing stone assembly 556 may be zeroed by installing the honing stone assembly 556 with no tension applied by springs 670. The adjustment screws 672 may be tightened such that springs 670 provide mechanical down pressure (or force) to the honing head 230 to overcome centrifugal forces. The spring 670 may also be used to provide tension to center the honing head 230 over the tubular and/or to provide adjustable tension to apply needed forces (and/or pressure) to the outer diameter of the tubular. This adjustment may be used to pre-load the honing stones 560 with force against the outer diameter of the tubular as needed to hone.

In an example, three honing stones 560 are positioned at about 120 degrees of about the honing head 230 (see, e.g., FIG. 5B) to provide self-centering of the tubular in honing head 230. The honing assembly 556 is provided with a preload of about 0.125 inches (0.32 cm) on springs 670 by providing two turns on the adjustment screws 672 of each honing assembly 556 relative to the marker. This force applies an abrasive force of from about 78 lbs (35.38 kg) to about 80 lbs (36.29 kg) for each honing stone 560.

The amount of torquing applied to the adjustable screw 672 and/or honing stone assembly 556 may be defined by experimental use, position indicator, measured torque, and/or other means. Additional torquing may optionally be provided to further extend the honing stones 560 to increase the abrasive forces on the tubular.

As shown in FIGS. 6, 8A, and 8B, a centering jig (or key) 680 may be positionable in the cavity 552 to center the honing stones 560 in the honing head 230. The centering jig 680 as shown is a pair of centering plates 682 with supports therebetween. The centering plates 682 are elliptical members having a periphery positionable along an inner surface of the honing head 230.

The centering plates 682 have inlets 684 extending into a periphery thereof. The inlets 684 are positionable in the honing head 230 to receive the honing stones 560. The honing stones 560 are positionable in the inlets 684 to adjustably position the honing stones 560. The inlets 684 may be sized to locate the honing stones 560 at a desired position within the cavity 552. For example, the centering jig 680 may be used to provide a positioning locator for the honing stones 560 within the honing head 230. This position may be defined to provide a desired abrasive force against the tubular and/or to center the tubular within the honing head 230. The centering jig 680 may provide an initial and/or zero position for placement of the honing stones 560 before adjustment.

FIG. 9 shows a schematic view of another version of a honing tool 923 positioned about a portion of the tubing 118 and pins 119 (see FIG. 2). The honing tool 923 is similar to the honing tool of FIGS. 2-8B, except that the honing tool 923 is supported about the tubular 118 by a mount in the form of a universal mounting wheel 985. FIGS. 10A-10B show additional exploded and perspective views of a portion of the honing tool 923 depicting the universal mounting wheel 985.

The mounting wheel 985 is a circular member receivable into the inlet (or opening) 986 of the tubing 118. The mounting wheel 985 may be connectable to the tubing 118 by connecting means, such as locking dogs 989. As shown in FIG. 10A, the locking dogs 989 are positioned along a periphery of the mounting wheel 985 for connection to the tubing 118.

As shown in FIG. 9, the central mounting provided by mounting wheel 985 defines a universal locator for supporting the honing tool 923 in various axial and rotational positions for engaging pins 119 at various positions about the tubing 118. The honing tool 923 is movably positionable about the mounting wheel 985 by an adjuster in the form of a bracket 987. One or more honing heads 923 may be positioned about the tubing 118 on the pins 119, and the honing tool 923 move to engage each of the honing heads 230 to hone the pins 119.

The base 232 of the honing tool 923 is supported on the mounting wheel by the bracket 987. As shown in FIG. 10A, the bracket 987 is depicted as a rectangular plate slidingly movable along the slider 988 to define a horizontal platform to receive the base 232. The bracket 987 has a notch 981 on an end thereof to facilitate placement (positioning) of the base 232 thereon. The base 232 may be attached to the bracket 987, for example, using a magnet. The base 232 may optionally be bolted to the bracket 987 by connectors (e.g., bolts).

The base 232 of the honing tool 923 is movably (axially and/or rotationally) positionable about the mounting wheel 985 by a slider 988 connected to the bracket 987. The slider 988 is connectable to the mounting wheel 985 by a connector 989 (e.g., a bolt). As shown, the mounting wheel 985 has a central hole to receive the connector 989 therethrough. The slider 988 may be one or more rods slidingly receiving the bracket 987 therealong to adjustably position the bracket 987 about the mounting wheel 985. The rod(s) may be threaded to linearly and/or rotationally drive the bracket 987 therealong and thereby position of the honing tool 923 about the tubing 118. In this manner, the honing tool 923 may be adjustably positionable about the tubing 118 for engaging one or more pins 119 thereabout while secured to the tubing 118.

While FIGS. 2-10B show various configurations of a honing tool 123, 923 the base, honing head, honing stone, mounting plates, mounting wheel, and/or brackets may have variations in shape/configuration. For example, the mounting plate, wheel, and/or brackets may be shaped to fit the space provided.

In operation, the honing tool 123, 923 may be provided for honing an outer diameter of a tubular, such as pin 119 or other tubular components. The honing stones 560 of the honing head 230 may be centered and positioned at a desired depth using centering jig 680 to obtain zero positioning. The honing stones 560 may then be adjusted to a desired depth, tension, and/or position using the adjustment screws 672.

The honing tool 123, 923 may be positioned on a workbench, on a riser 106, or on other locations, such as wellsite 100 of FIG. 1. The honing head 230 may then be positioned on an end of the tubular. The honing head 230 may be rotationally and/or axially driven such that the honing stones 560 to engage the outer diameter of the tubular.

FIG. 11 is a flow chart depicting methods 1100 of machining (e.g., honing) a tubular (e.g., pin or other tubular component). The method 1100 involves 1190—providing a honing tool for honing the tubular. The honing tool includes a base and a honing head. The a honing head may be supported by the base and rotatable by a rotational driver. The honing tool may also include a rotational driver supported by the base, and honing stones supported by the honing head. The honing head includes a honing shell disposable about an end of the tubular with the honing stones adjustably positionable about the honing shell.

The method may also involve 1192—adjustably positioning the honing stones in the honing head, 1194—mounting the honing tool about a wellsite component (e.g., onto a platform about the tubular), 1196—disposing the honing head about the tubular, 1198—rotating the honing head, and/or 1199—axially moving the honing head along the tubular.

The method may also involve operatively connecting the base to the tubular; disposing the honing head with the honing stones therein about the pins; and rotationally engaging the pins with the honing stone. The operatively connecting may involve operatively connecting the base to the tubular with at least one of a mounting plate and a bracket. The disposing may involve centering the honing stones about an inner periphery of the honing head, adjustably positioning the honing stones in the honing head, springingly supports the honing stones about an inner periphery of the honing head, axially moving the honing head about the pins, and/or terminating the axially moving with a stop.

One or more of these and other portions of the method may be performed. The methods may be performed in any order, and repeated as desired.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the subject matter may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, the honing tool may have any number of stones adjustably and/or springingly positionable about a tubular; and/or various combinations of the features of the honing tools depicted herein may be provided.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A tool for honing a tubular component of a wellsite, the honing tool comprising:

a base operatively connectable to a flange of a wellsite component, wherein the wellsite component is configured to receive at least a portion of the tubular component through a tubular component hole disposed through the flange of the wellsite component;

a honing head supported by the base and positionable about the tubular component;

honing stones supported about the honing head, the honing stones engageable with an outer surface of a portion of the tubular component extending from the tubular component hole; and a driver to rotationally drive the honing head whereby the honing stones hone an outer periphery of the tubular component.

2. The honing tool of claim 1, further comprising a mounting plate configured to operatively connect the base to the flange of the wellsite component.

3. The honing tool of claim 2, further comprising a bracket supported on a surface of the mounting plate and configured to operatively connect the base to the mounting plate.

4. The honing tool of claim 1, wherein the driver axially drives the honing head.

5. The honing tool of claim 1, wherein the honing head has tubular body with a stop plate at an end thereof, the honing head having a cavity to receive the tubular component therein.

6. The honing tool of claim 1, wherein the honing stones are positioned about an inner surface of the honing head.

7. The honing tool of claim 6, wherein the honing stones comprise three honing stones spaced equally about an inner periphery of the honing head.

8. The honing tool of claim 1, further comprising supports to support the honing stones in the honing head.

9. The honing tool of claim 8, wherein the supports comprise at least one of a platform, a rod, a spring, a collar, and an adjustment screw.

10. The honing tool of claim 1, further comprising a stop positionable in the honing head, the stop comprising a wear disk engageable by the tubular component.

11. The honing tool of claim 1, wherein the wellsite component is at least one of a tubing, a riser, a flange, a workbench, and a combination thereof.

12. The honing tool of claim 11, wherein the tubular component comprises at least one pin of a riser.

13. An assembly for honing a tubular component of a wellsite, the honing assembly comprising:

a honing tool, comprising:

a base operatively connectable to a flange of a wellsite component via a mount, wherein the wellsite component is configured to receive at least a portion of the tubular component through a tubular component hole disposed through the flange of the wellsite component;

a honing head supported by the base and positionable about the tubular component;

honing stones supported about the honing head, the honing stones engageable with an outer surface of a portion of the tubular component extending from the tubular component hole; and a driver to rotationally drive the honing head whereby the honing stones hone an outer periphery of the tubular component.

14. The honing assembly of claim 13, further comprising connectors to secure the base to the mount.

15. The honing assembly of claim 13, wherein the mount comprises a mounting plate.

16. The honing assembly of claim 13, wherein the mount comprises a mounting wheel.

17. The honing assembly of claim 13, wherein the mount further comprises clamps.

18. The honing assembly of claim 13, wherein the mount further comprises handles.

19. The honing assembly of claim 13, further comprising an adjuster adjustably connecting the base to the mounting plate.

20. The honing assembly of claim 19, wherein the mount has slots therein and the adjuster comprises a bracket slidably movable about the slots.

21. The honing assembly of claim 19, wherein the adjuster comprises a plate operatively connectable to the base and rods slidably extendable therefrom, the rods operatively connectable to the mount.

22. The honing assembly of claim 13, further comprising a fluid source extending into the honing head.

23. The honing assembly of claim 13, further comprising a centering jig positionable in the honing head, the centering jig having inlets defining a position of the honing stones in the honing head.

24. A method of honing a tubular component of a wellsite, the method comprising:

providing a honing tool comprising a base and a honing head;

adjustably positioning honing stones in the honing head;

mounting the honing tool to a flange of a wellsite component, wherein the wellsite component is configured to receive at least a portion of the tubular component through a tubular component hole disposed through the flange of the wellsite component;

disposing the honing head about an outer surface of a portion of the tubular component extending from the tubular component hole; and rotating the honing head.

25. The method claim 24, further comprising axially moving the honing head along the tubular component.

26. The method claim 24, wherein the mounting comprises operatively connecting the base to a flange of the wellsite component via a mounting plate and an adjuster.

27. The method of claim 24, wherein the disposing comprises centering the honing stones about an inner periphery of the honing head.

28. The method of claim 24, wherein the disposing comprises adjustably positioning the honing stones in the honing head.

29. The method of claim 24, wherein the disposing comprises springingly supporting the honing stones about an inner periphery of the honing head.

30. The method of claim 24, further comprising axially moving the honing head about the tubular component.

31. The method of claim 30, further comprising terminating the axially moving with a stop.

* * * * *